US005702220A

United States Patent [19]

Combs

[11] Patent Number: 5,702,220

[45] Date of Patent: Dec. 30, 1997

[54] METHOD AND APPARATUS FOR ELIMINATION OF ADHESIVE STRINGERS DURING PERFECT BINDING

[76] Inventor: Jeff Combs, 179 Country Aire, Greenwood, Ind. 46143

[21] Appl. No.: 796,953

[22] Filed: Feb. 7, 1997

Related U.S. Application Data

[63] Continuation of Ser. No. 429,629, Apr. 27, 1995, abandoned.

[51] Int. Cl.[6] ..... B42C 9/00

[52] U.S. Cl. ..... 412/8; 412/11; 412/14; 412/37; 118/59

[58] Field of Search ..... 412/8, 11, 14, 412/37, 900, 902; 156/908; 427/208.2, 285, 358, 428; 118/58, 59

[56] References Cited

U.S. PATENT DOCUMENTS

| | | | |
|---|---|---|---|
| 3,956,057 | 5/1976 | Jung | 156/578 |
| 3,980,514 | 9/1976 | Rosette et al. | 156/477 |
| 4,014,732 | 3/1977 | Beckert et al. | 156/908 X |
| 4,117,800 | 10/1978 | Maus et al. | 118/7 |
| 4,179,325 | 12/1979 | Staats et al. | 156/498 |
| 4,373,985 | 2/1983 | Glendening | 118/103 |
| 4,408,780 | 10/1983 | Detterman et al. | 281/15 |
| 4,512,945 | 4/1985 | Vigano | 264/263 |
| 4,925,354 | 5/1990 | Cote | 412/8 |
| 4,925,355 | 5/1990 | Faber et al. | 412/37 |
| 5,114,292 | 5/1992 | Geiser | 412/11 |
| 5,129,772 | 7/1992 | Slautterback | 412/8 |
| 5,152,654 | 10/1992 | Luhman et al. | 412/37 |
| 5,194,116 | 3/1993 | Davis et al. | 156/578 |
| 5,221,112 | 6/1993 | Holmberg | 281/21 |
| 5,250,318 | 10/1993 | Tooker | 427/8 |
| 5,271,794 | 12/1993 | Jarrell et al. | 156/578 |
| 5,340,155 | 8/1994 | Podosek | 281/29 |
| 5,418,009 | 5/1995 | Raterman et al. | 412/8 X |
| 5,443,639 | 8/1995 | Hawkes | 412/37 X |

FOREIGN PATENT DOCUMENTS

| | | | |
|---|---|---|---|
| 27 16 575 | 10/1978 | Germany | 412/37 |

*Primary Examiner*—S. Thomas Hughes
*Attorney, Agent, or Firm*—Woodard, Emhardt, Naughton Moriarty & McNett

[57] ABSTRACT

A perfect binding apparatus having a plurality of pockets, each of which releasably engage a book to be bound. The pockets are sequentially passed over a glue pot by means of a conveyor chain coupled to each pocket. A hot melt adhesive is applied to the bottom edge of each book as it passes over the glue pot. Gravity, along with the liquidity of the glue, causes a portion of the adhesive to fall away from the book as the pocket transports the book downstream from the glue pot, thereby forming undesirable adhesive stringers. A plurality of heaters are positioned downstream from the glue pot and mounted at an elevation at which the bottom edge of the book just clears the top edge of the heater as the book passes over the heater. The heaters are kept at a temperature which is in excess of the melting point of the adhesive, therefore the stringers are continuously melted and removed from the books as they pass over the heaters.

20 Claims, 5 Drawing Sheets

METHOD AND APPARATUS FOR ELIMINATION OF ADHESIVE STRINGERS DURING PERFECT BINDING

This application is a continuation of application Ser. No. 08/429,629, filed Apr. 27, 1995, now abandoned.

TECHNICAL FIELD OF THE INVENTION

The present invention generally relates to a perfect binding process and, more particularly, a method and apparatus for elimination of adhesive stringers during perfect binding.

BACKGROUND OF THE INVENTION

Perfect binding is very popular because it is much faster and less expensive than side sewing or spine sewing, and it can be used to manufacture books which are too thick for saddle stitching. With the perfect binding process, the backs and certain other portions of stacks of paper are coated with adhesive prior to attachment of covers. Such machines can be utilized for mass production of books (e.g. soft cover books) brochures, pamphlets and similar printed products. It is known in the art to provide a perfect binder with a transporting unit having a set of pockets which can be closed to engage discrete stacks of paper, herein referred to as books, at a receiving location and to thereupon advance the engaged books past several successive treating stations where various tools treat selected portions of the books. For example, the pockets may be transported past a glue pot where melted adhesive is applied to a portion of the sheets which extend downwardly beyond the undersides of each respective pocket. After passing through the glue pot, the pockets transport each book to a portion of the binder which applies an exterior cover over the book, the cover being held thereto by means of the adhesive.

The adhesive used in the glue pot of the perfect binding machinery is a hot melt adhesive which is selected because it has a quick setting time. This presents a problem, however, in that after the book is passed through the glue pot, adhesive dripping from the bottom of each book quickly sets up and forms what are commonly referred to as "stringers" in the perfect binding art. Such stringers are merely elongated strings of glue which hang from the bottom of each book. Such stringers present major problems to the operation and upkeep of perfect binding machinery, because they contaminate all portions of the perfect binder which are downstream from the glue pot with sticky glue waste as the pockets traverse these portions of the machinery. This necessitates shutting down the machinery at regular intervals and cleaning this excess glue from the binding machinery with a razor blade. This can mean 20–30 minutes of downtime between each binding run. Consequently, there have been several attempts in the prior art to eliminate such stringers from the perfect binding process, however none of these attempts has been successful.

For example, U.S. Pat. No. 4,373,985 to Glendening discloses the use of a set of wires strung across the top of the glue pot to scrape excess glue, such as glue stringers, from the edge of a book after the book passes over a gluing roller. It has been found in practice, however, that such methods are largely unsuccessful in eliminating all stringers from the bottom of the books as they are fed through the perfect binding machinery.

There is therefore a need in the art for a perfect binding apparatus which will eliminate all stringers from the bottom of the glued books. The present invention is directed towards meeting this need.

SUMMARY OF THE INVENTION

The present invention relates to a perfect binding apparatus having a plurality of pockets, each of which releasably engage a book to be bound. The pockets are sequentially passed over a glue pot by means of a conveyor chain coupled to each pocket. A hot melt adhesive is applied to the bottom edge of each book as it passes over the glue pot. Gravity, along with the liquidity, causes a portion of the adhesive to fall away from the book as the pocket transports the book downstream from the glue pot, thereby forming undesirable adhesive stringers. A plurality of heaters are positioned downstream from the glue pot and mounted at an elevation at which the bottom edge of the book just clears the top edge of the heater as the book passes over the heater. The heaters are kept at a temperature which is in excess of the melting point of the adhesive, therefore the stringers are melted and removed from the books as they pass over the heaters.

In one form of the invention a perfect binding apparatus is disclosed, comprising at least one pocket adapted to releasably engage a book to be bound; a glue pot adapted to hold a quantity of adhesive; a conveyor coupled to the pocket and operable to move the pocket from an upstream side of the glue pot to a downstream side of the glue pot such that a portion of the adhesive is applied to an end of the book; and at least one heater situated on the downstream side of the glue pot, the heater operable to reach a heater temperature which is greater than a melting point of the adhesive; wherein stringers of the adhesive which descend from the book make contact with the at least one heater and are thereby melted and separated from the book.

In another form of the invention a perfect binding apparatus is disclosed, comprising at least one pocket adapted to releasably engage a book to be bound, wherein an end of the book is coated with an adhesive; a conveyer coupled to the pocket and operable to move the pocket; and at least one heater operable to reach a heater temperature which is greater than a melting point of the adhesive; wherein the end of the book moves past the at least one heater as the conveyor moves the pocket, such that stringers of the adhesive on the book make contact with the at least one heater and are thereby melted and separated from the book.

In another form of the invention a method for perfect binding a book of sheets is disclosed, comprising the steps of: (a) melting a quantity of adhesive; (b) moving the book through the adhesive such that adhesive adheres to an end of the book; and (c) heating stringers that descend from the adhesive on the book to a heater temperature which is greater than a melting point of the adhesive, thereby melting and separating the stringers from the book.

DETAILED DESCRIPTION OF THE PREFERRED EMBODIMENTS

Figure 1:
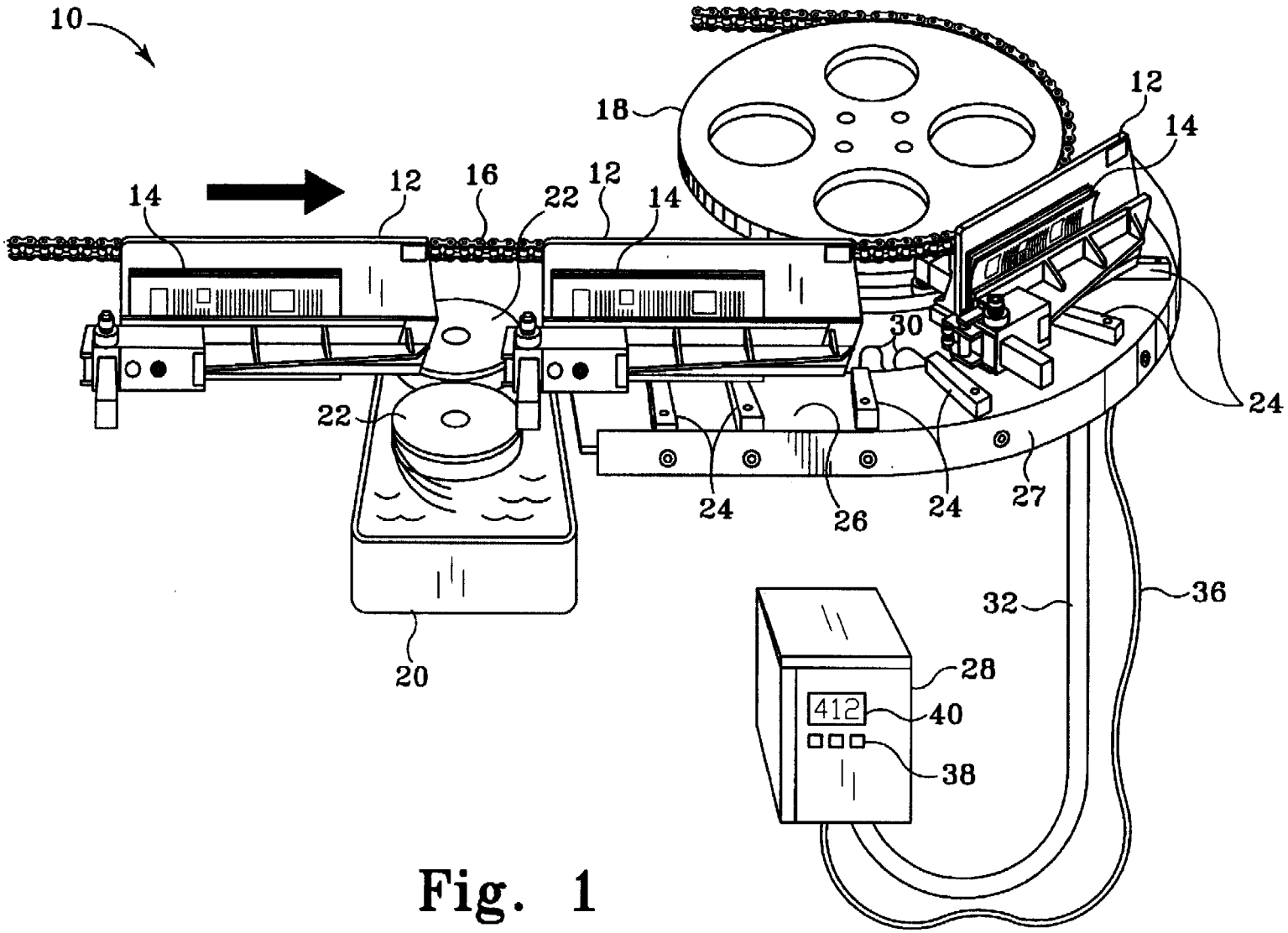
FIG. 1 is a perspective view of a first embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, there is illustrated a perspective view of a first embodiment perfect binding apparatus of the present invention, indicated generally at 10. The binder 10 includes a plurality of pockets 12 which employ compressive tongs to securely hold books 14 to be bound, as is known in the art. Each of the pockets 12 is coupled to a continuous chain 16 which is turned during the binding process by a geared wheel 18. In this manner, successive books 14 are gripped by the pockets 12 and transported through the binding apparatus 10 in a continuous process. The pockets 12 move in a downstream direction as indicated by the arrow. It will be appreciated by those skilled in the art that only a portion of the binder 10 has been illustrated in FIG. 1, the non-illustrated portions being typical of perfect binders known in the art and not specifically relating to the invention described herein.

The binder 10 includes a glue pot 20 which contains a supply of liquid hot melt adhesive, which is kept at a temperature above its melting point. The glue pot 20 includes a pair of rollers 22 which are operative to apply the melted adhesive to the bottom portion of each book 14 as it passes directly over the glue pot 20. The vertical positioning of the pockets 12 with respect to the rollers 22 is such that the liquid adhesive is applied to the portion of the book 14 which hangs below the bottom surface of the pocket 12. In this manner, liquid adhesive is applied to the spine of each book 14 as it passes through this portion of the binder 10. As each pocket 12 exits the area of the glue pot 20, it executes a 180° turn around the end of the binder 10 in preparation for the application of a cover over the book 14. The portion of the binder 10 which executes this operation is not illustrated in the drawing figure, it being understood that those skilled in the art are familiar with this operation. It is in the region of the binder 10 between the glue pot 20 and the cover application section in which the stringers are particularly problematic. This is due to the fact that as each book 14 exits the area of the glue pot 20, the entire bottom portion of the book 14 is coated with hot liquid adhesive. Because the adhesive is liquid at this time, the natural force of gravity, along with the liquidity of the glue, tends to pull the adhesive downward and away from the bottom of the book 14. As the pocket 12 moves away from the heated glue pot 20, the temperature surrounding the book 14 rapidly decreases, causing the adhesive to begin to set up. This is particularly true of the stringers which are now hanging down below the main body of the book 14, and are therefore separated from the thermal mass provided by the book 14 which tends to slow the cooling of the adhesive adhered directly thereto. Such pockets have a tendency to become attached to the various portions of the binder 10 between the glue pot 20 and the cover application section, thereby fouling the machinery of the binder 10 with large quantities of sticky glue. Because of this, it is necessary to periodically shut down the binder 10 so that such excess glue may be cleaned therefrom.

In order to eliminate the problems caused by such stringers, the binder 10 of the present invention incorporates a plurality of heaters 24 which are mounted at successive intervals on a tray 26 which is positioned below the path executed by the pockets 12 as they leave the glue pot 20. The tray 26 is preferably formed from a heat conducting metal, such as sheet metal, for reasons which will be explained hereinbelow. A transverse metal guard 27 is coupled to the outer edge of the tray 26. Each of the heaters 24 is coupled to a thermostat control device 28 by means of individual wires 30 which run through the conduit 32. Furthermore, a temperature sensing thermocouple probe 34 (see FIG. 3) is coupled to the thermostat 28 by means of the wire 36. The thermocouple 34 measures the temperature of one of the heaters 24. The thermostat 28 includes a plurality of buttons 38 which may be used by an operator of the binder 10 in order to control the temperature of the heaters 24. For example, a desired set temperature of the heaters 24 may be entered with the buttons 38. The thermostat 28 further includes a display 40, such as a light emitting diode display, which displays, for example, the set temperature of the heating elements 24.

Figure 2:
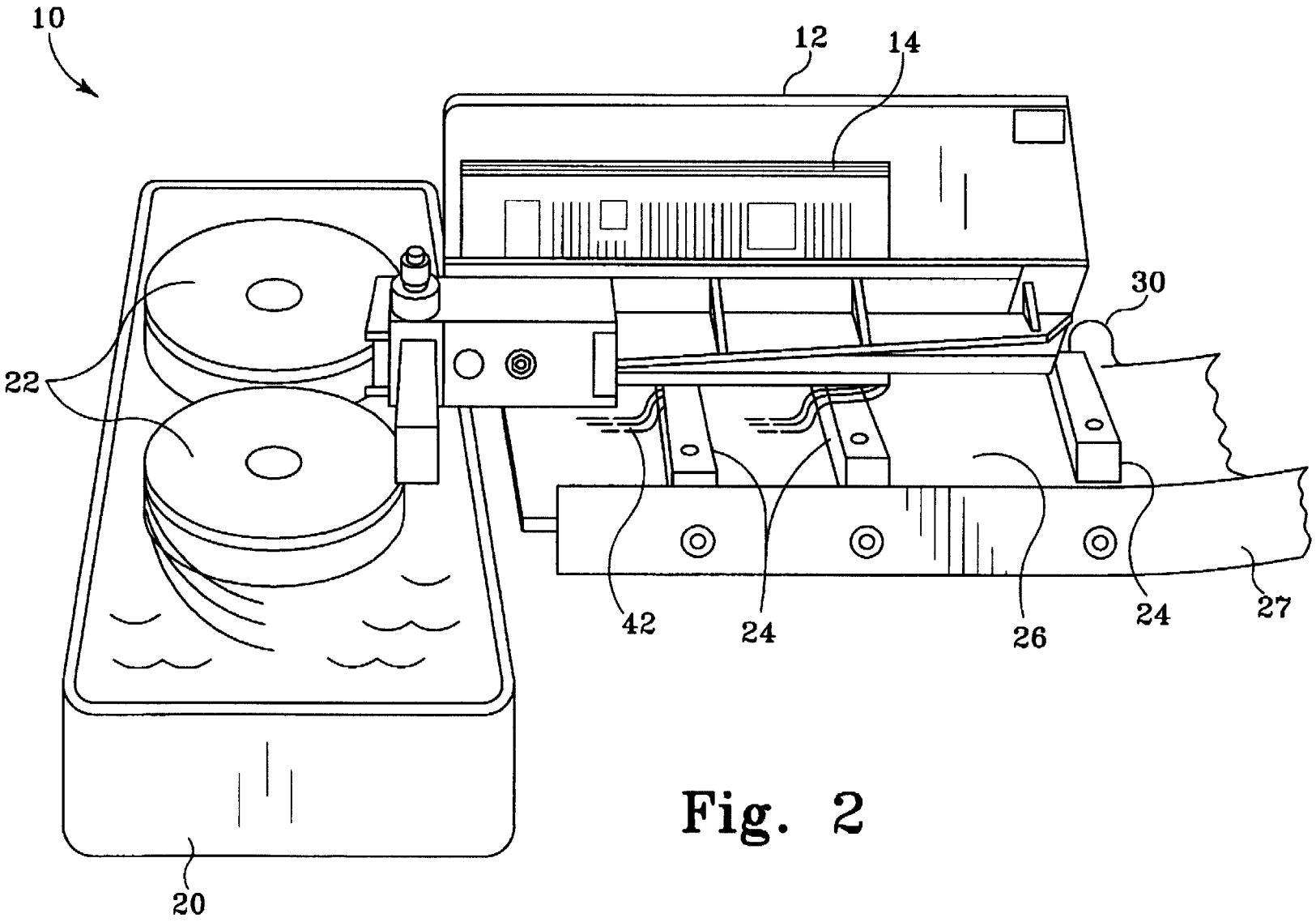
FIG. 2 is a magnified perspective view of a portion of the first embodiment of the present invention.

Referring now to FIG. 2, there is illustrated a magnified view of the binder 10 in the area of the glue pot 20 and immediately downstream therefrom. Several stringers 42 descending from the book 14 are visible in the view of FIG. 2. The stringers 42 descend from the books 14 and, as the pocket 12 moves over the heaters 24, the stringers 42 make contact with the heaters 24. The thermostat 28 is preferably set such that the heaters 24 are maintained at a set temperature which is substantially hotter than the melting point of the hot melt adhesive. For instance, the adhesive may have a melting point of 350° F., while the heaters 24 are maintained at a set temperature of 412° F. Therefore, when the stringers 42 make contact with any of the heaters 24, the stringer 42 is melted and, in most cases, substantially vaporized, thereby removing the stringer 42 from the book 14. Because much of the glue in the stringers 42 is vaporized, a relatively small amount of glue will collect on the tray 26 surrounding the heaters 24. The amount of glue thus accumulating is relatively small, and may be cleaned from the tray 26 on a relatively infrequent basis, such as once per week.

The heaters 24 are mounted on the tray 26 in such a position that there is approximately 1/16 of an inch clearance between the top of each heater 24 and the bottom most edge of each book 14 as the book 14 moves across the heater 24. Such a small clearance between the books 14 and the heaters 14 insures that all of the stringers 42 which form on the books 14 will be removed by the heaters 24. A second important advantage supplied by the heaters 24 is the fact that the metal tray 26 to which the heaters 24 are mounted acts as a heat sink, spreading the heat from each heater 24 to the immediate surrounding area. The result is that the entire area around the tray 26 remains at an elevated temperature, somewhat less than the actual temperature of the heaters 24. This is advantageous when the binder 10 must be stopped for some reason, which will cause books 14 which have already had glue applied thereto to become momentarily stationary over the area of the tray 26. Because this area is kept at an elevated temperature by means of the heaters 24 and the tray 26, the glue applied to the books 14 in this area will remain above the adhesive melt temperature and will not set up. Therefore, when the binder 10 is restarted, the books may proceed to the cover application section and be bound in the normal manner. Without this elevated temperature in the area of tray 26, the glue on the books 14 could set up and no longer be effective in attaching the covers, thereby ruining these items. It will be appreciated by those skilled in the art that the temperature of the heaters 24 is preferably set to be substantially above the melting point of the hot melt adhesive in order to completely remove any stringers 42 from the books 14, however the temperature must not be set too high or the adhesive applied to the book 14 will be melted therefrom.

Figure 3:
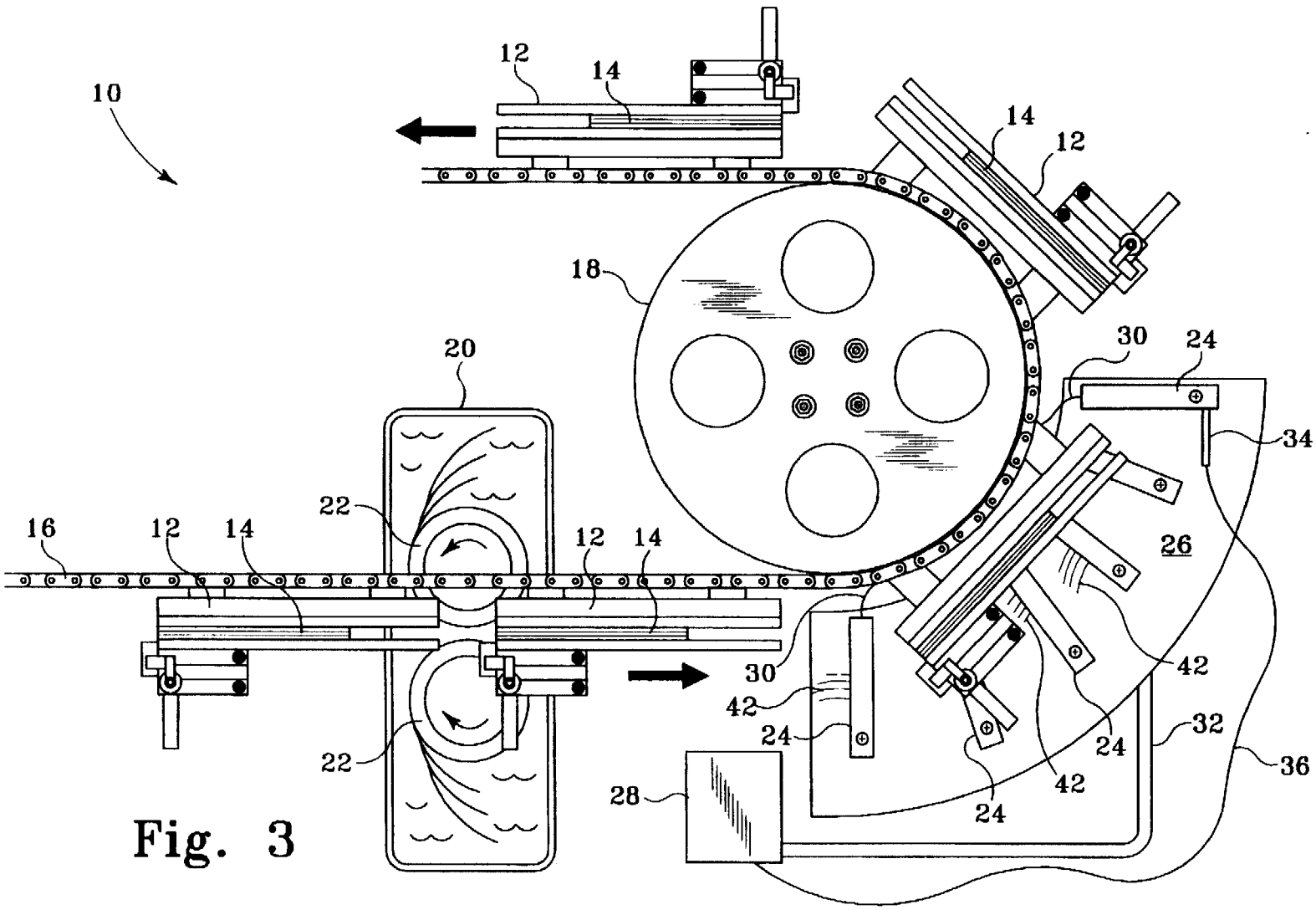
FIG. 3 is a top plan view of the first embodiment of the present invention.

Referring now to FIG. 3, the binder 10 is shown in the top plan view. As visible in the view of FIG. 3, the plurality of heaters 24 are placed in an arc around the curve executed by each of the pockets 12. It is preferred that the heaters 24 be sufficiently wide to cover the entire width of the path executed by each pocket 12 as it traverses the turn of the binder 10. In this way, all sections of the bottom of the book 14 will pass over multiple heaters 24 as the pocket 12 executes the turn. This ensures that all stringers 42 hanging from the bottom of the book 14 are removed before the pocket 12 exits the area of the heaters 24.

Figure 5:
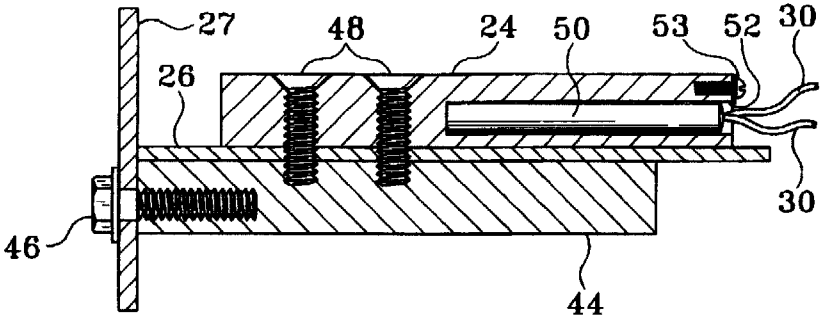
FIG. 5 is a cross sectional view of the first embodiment heating element of the present invention.
Figure 4:
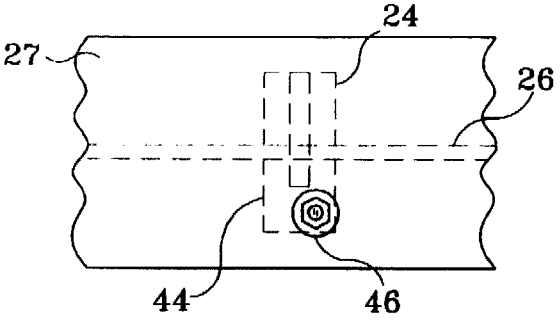
FIG. 4 is a side elevational view of a first embodiment heating element of the present invention.
Figure 6:
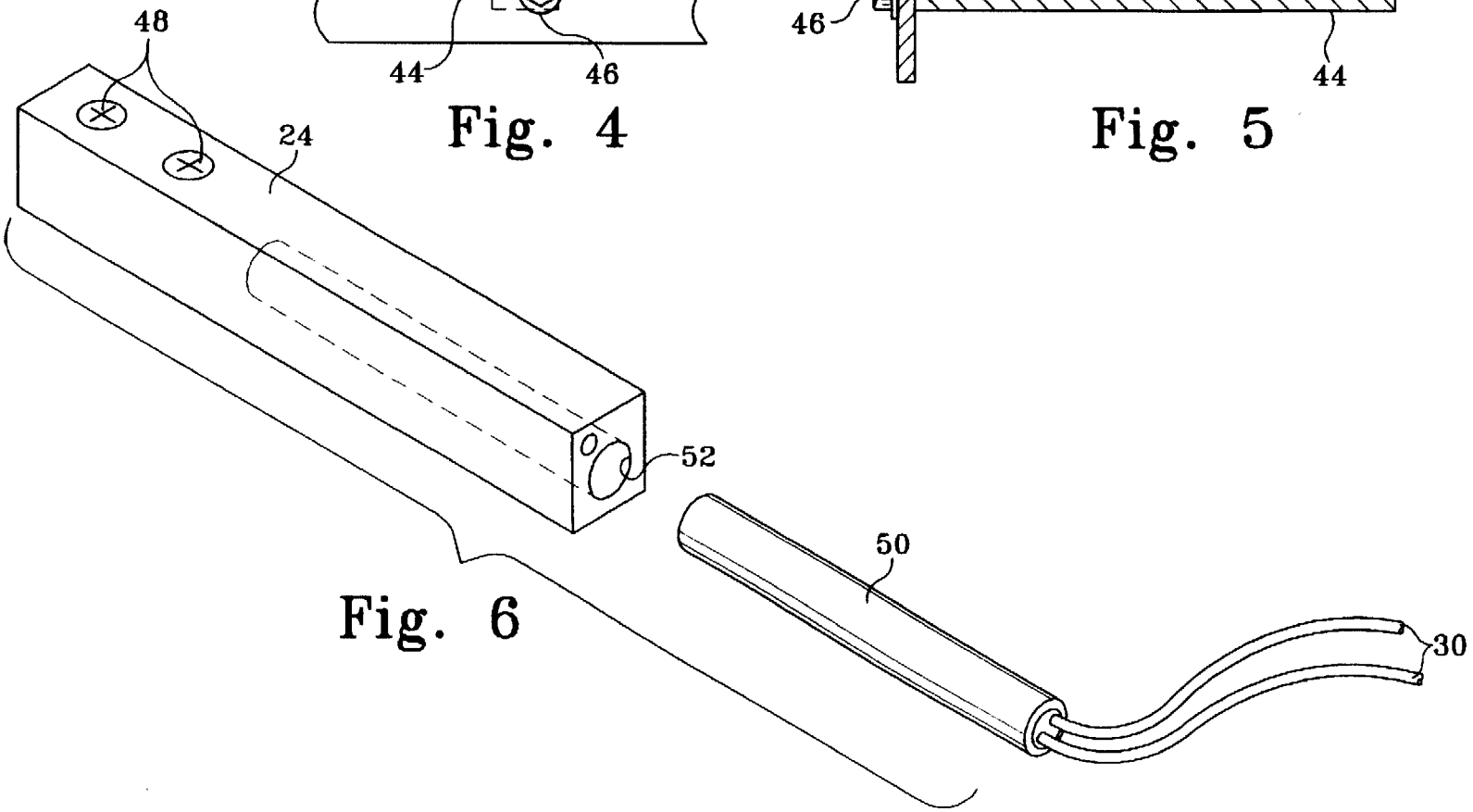
FIG. 6 is an exploded perspective view of the first embodiment heating element of the present invention.

Referring now to FIG. 4, there is illustrated an elevational side view of a heater 24 mounted to the tray 26. Each of the heaters 24 is mounted to a mounting bar 44 located on the opposite side of the tray 26. In turn, the mounting bar 44 is coupled to the guard 27 by means of a bolt 46. This mounting arrangement is more clearly shown in the cross sectional view of FIG. 5. The coupling of the heater 24 to the mounting bar 44 is made by means of countersunk screws 48 which pass through the tray 26. Each of the heaters 24 includes a cylindrical heating element 50 which is inserted into a bore 52 into the end of the heater 24. The heating element 50 is secured within the bore 52 by means of a bolt and washer combination 53. The heating element 50 is preferably a ⅜ inch×3 inch cartridge heating element, such as a model CR-33-11, sold by Akinsun Heat of Streamwood, Ill. The heating element 50 is capable of producing temperatures in the range of 350°–500° F. An exploded perspective view of the heater 24 assembly is illustrated in FIG. 6.

Figure 7:
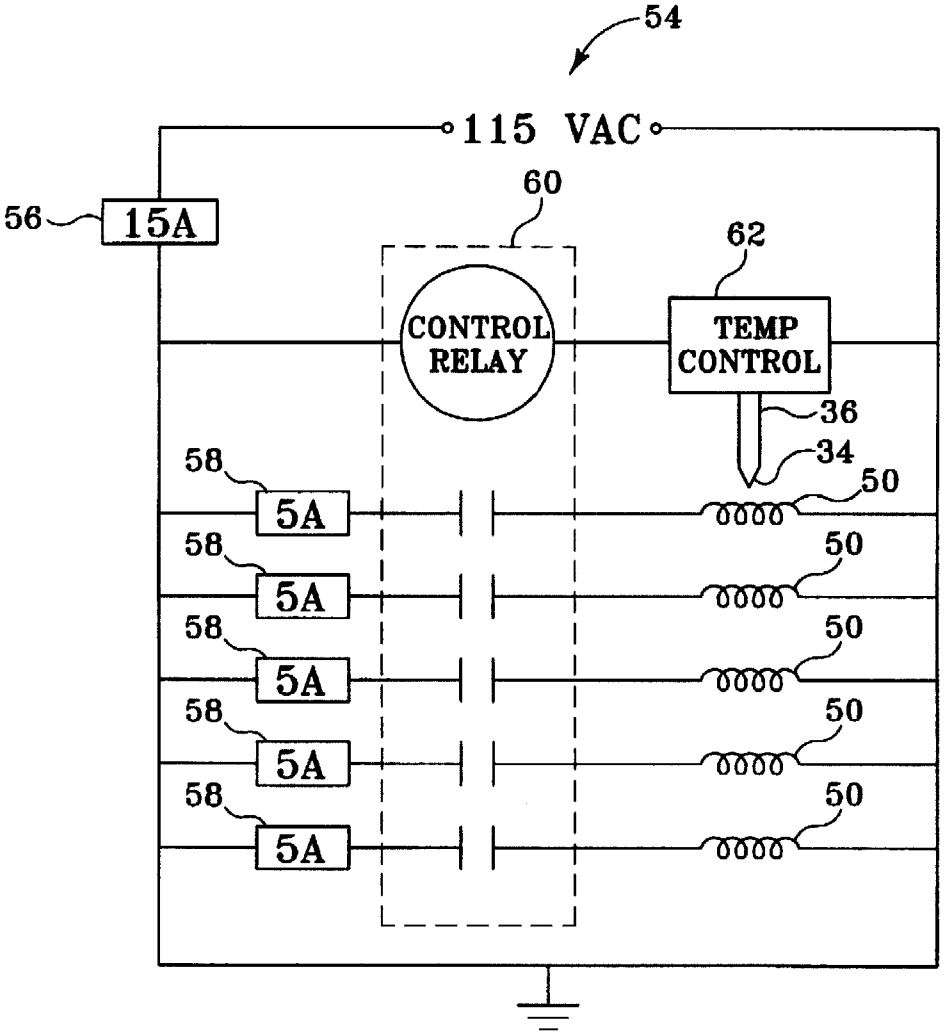
FIG. 7 is a schematic electrical diagram of a first embodiment temperature control circuitry of the present invention.

Referring now to FIG. 7, the control circuitry of the thermostat 28 and the heating elements 50 are illustrated schematically. The circuit is powered by a 115 V AC power source 54 which is supplied to each of the heating elements 50 through a master 15 amp fuse 56 and individual 5 amp fuses 58 for each heating element 50. Additionally, a control relay 60 is placed between each fuse 58 and its associated heating element 50. A thermostatic temperature controller 62 is also provided which receives an input from the thermocouple 34 through the wires 36. The control relay 60 and temperature controller 62 are coupled in series and powered by the 115 V AC supply 54. The temperature controller 62 is preferably a type J controller, such as the model E5CS manufactured by Omron. Such type J controllers have an operating range of 33° F.–999° F. The thermocouple 34 is preferably a type J thermocouple such as that manufactured by Chromolux.

In operation, a set temperature is entered into the temperature controller 62 by an operator of the binder 10 by means of the buttons 38. The temperature controller 62, working with feedback from the thermocouple 34, will maintain the temperature of the heaters 24 within a preset window around the set temperature. The temperature controller 62 is normally an open circuit, but when it determines that the heaters 24 have fallen outside of the allowable window, the controller 62 doses, thereby closing each of the control relays 60 and energizing the heating elements 50. This condition will be maintained until the thermocouple 34 indicates that the temperature has reached a reasonably high level, at which point the temperature controller 62 will once again become an open circuit, thereby turning off the control relay 60 and disconnecting power from the heating elements 50. In this way, the heater cycles up and down in a temperature window around the set temperature. Because of this cycling, the heating elements 50 are not energized all of the time, and the life of such heating elements 50 is thereby greatly increased.

It will be appreciated by those skilled in the art that the incorporation of the heaters 24 in the perfect binder 10 of the present invention is effective in eliminating the stringers 42 which form on the bottom of the books 14 as they exit the glue pot 20. Because the stringers 42 are detached from the books 14 and essentially vaporized, the books 14 are cleaned of such stringers 42 and excessive glue build up does not occur on this portion of the binder 10. Because the glue build up exhibited in prior art binding machinery is avoided, excessive downtime of the binder 10 is not required in order to clean the glue therefrom. The present invention therefore reduces the downtime of the binder 10 in addition to improving the quality of the bound products produced therefrom.

Another important advantage of the present invention is that the glue never strings on the inside of the back of the cover. Such strings are impossible to see unless the worker opens every book while its being bound. When glue strings inside the back cover, it causes the cover and the last page to stick together, a condition which ruins the book. If one bad book is found by the machine operator, the chances are that there will be more bad books which won't be found until they reach the customer. That can be very costly in the binding industry.

The consecutive heaters employed according to the present invention assure that, even though the machine moves the books very fast, and the liquidity of the glue and the force of gravity causes the glue to start stringing before the book reaches the cover installation station, the present invention continuously eliminates the strings completely from the time that the glue is applied to the time the book reaches the cover installation station. In addition, the length of each heater provides that, even though the speed of the machine and the books traveling around a 180° turn tend to throw the glue strings outward to the side, the length of these heaters catches the glue wherever the strings go and eliminates them.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A perfect binding apparatus, comprising:

at least one pocket adapted to releasably engage a book to be bound;

a glue pot adapted to hold a quantity of adhesive;

a conveyor coupled to the at least one pocket and operable to move the at least one pocket from an upstream side of the glue pot to a downstream side of the glue pot such that a portion of the adhesive is applied to an end of the book; and at least one solid heater situated on the downstream side of the glue pot, the at least one solid heater having a heater surface maintained at a heater temperature which is greater than a melting point of the adhesive;

wherein stringers of the adhesive which descend from the book make contact with the heater surface of the at least one solid heater and are thereby melted and separated from the book.

2. The perfect binding apparatus of claim 1, wherein the at least one pocket engages the book by applying a compressive force to the book with a pair of tongs.

3. The perfect binding apparatus of claim 1, wherein the adhesive is a hot melt adhesive which is heated to above the melting point.

4. The perfect binding apparatus of claim 1, wherein the conveyor comprises a continuous chain driven by a gear.

5. The perfect binding apparatus of claim 1, wherein a top surface of the at least one solid heater is situated approximately one-sixteenth of an inch from the end of the book.

6. The perfect binding apparatus of claim 1, further comprising a heat sink coupled to the at least one heater and operative to increase an area warmed by the at least one heater.

7. The perfect binding apparatus of claim 1, further comprising a controller coupled to the at least one heater and operative to maintain the heater temperature substantially at a set temperature.

8. The perfect binding apparatus of claim 7, further comprising a temperature sensor operative to measure the heater temperature and to communicate the measurement to the controller.

9. The perfect binding apparatus of claim 1, wherein each of the at least one heaters comprises:

a heater body having a longitudinal bore formed at least part way therethrough; and a heating element situated within the bore.

10. A perfect binding apparatus, comprising:

at least one pocket adapted to releasably engage a book of sheets to be bound, wherein an end of the book is coated with an adhesive;

a conveyer coupled to the at least one pocket and operable to move the at least one pocket; and at least one solid heater having a heater surface maintained at a heater temperature which is greater than a melting point of the adhesive;

wherein the end of the book moves past the at least one solid heater as the conveyor moves the at least one pocket, such that stringers of the adhesive on the book make contact with the heater surface of the at least one solid heater and are thereby melted and separated from the book.

11. The perfect binding apparatus of claim 10, wherein the at least one pocket engages the book by applying a compressive force to the book with a pair of tongs.

12. The perfect binding apparatus of claim 10, wherein the adhesive is a hot melt adhesive which is heated to above the melting point.

13. The perfect binding apparatus of claim 10, wherein the conveyor comprises a continuous chain driven by a gear.

14. The perfect binding apparatus of claim 10, wherein a top surface of the at least one solid heater is situated approximately one-sixteenth of an inch from the end of the book.

15. The perfect binding apparatus of claim 10, further comprising a heat sink coupled to the at least one heater and operative to increase an area warmed by the at least one heater.

16. The perfect binding apparatus of claim 10, further comprising a controller coupled to the at least one heater and operative to maintain the heater temperature substantially at a set temperature.

17. The perfect binding apparatus of claim 16, further comprising a temperature sensor operative to measure the heater temperature and to communicate the measurement to the controller.

18. The perfect binding apparatus of claim 10, wherein each of the at least one heaters comprises:

a heater body having a longitudinal bore formed at least part way therethrough; and a heating element situated within the bore.

19. A method for perfect binding a book, comprising the steps of:

(a) melting a quantity of adhesive;

(b) moving the book through the adhesive such that adhesive adheres to an end of the book; and (c) causing stringers that descend from the adhesive on the book to impact a solid heater having a heater surface maintained at a heater temperature which is greater than a melting point of the adhesive, thereby melting and separating the stringers from the book.

20. The method of claim 19, wherein step (c) further comprises the steps of:

(c.1) providing at least one heater;

(c.2) providing power to each of the at least one heaters in order to raise the heater temperature;

(c.3) measuring the heater temperature; and (c.4) disconnecting power to each of the at least one heaters if the measured heater temperature is above a predetermined set temperature.

* * * * *